US005421554A

United States Patent [19]

Hsu, Kun-Shan

[11] Patent Number: 5,421,554

[45] Date of Patent: Jun. 6, 1995

[54] JACK ASSEMBLY

[76] Inventor: Hsu, Kun-Shan, No. 3, Ha Ko Liau, Pei Hou Lei, Chia Yi, Taiwan, Prov. of China

[21] Appl. No.: 351,123

[22] Filed: Nov. 30, 1994

[51] Int. Cl.[6] ..... B66F 3/00

[52] U.S. Cl. ..... 254/8 B; 254/93 H; 254/124

[58] Field of Search ..... 254/93 H, 93 R, 8 B, 254/8 R, 9 B, 9 R, 10 B, 10 R, 124, 126, 122

[56] References Cited

U.S. PATENT DOCUMENTS 3,806,093 4/1974 Itazu ..... 254/124
5,211,375 5/1993 Wang ..... 254/93 H
5,364,071 11/1994 Lu ..... 254/124

*Primary Examiner*—Robert C. Watson
*Attorney, Agent, or Firm*—Morton J. Rosenberg; David I. Klein

[57] ABSTRACT

A jack includes two cylinder disposed on a base and actuated respectively for elevating vehicles having either lower or nigher base. A slide is slidably engaged on a larger cylinder and secured to a smaller cylinder so as to be moved upward by the smaller cylinder. Two pairs of levers are pivotally coupled between a support and the slide and a pair of links pivotally couple the levers to the larger cylinder. The support is elevated when the slide is moved upward by the smaller cylinder, and the support is further elevated when the larger cylinder is actuated.

4 Claims, 6 Drawing Sheets

JACK ASSEMBLY

BACKGROUND OF THE INVENTION

1. Field of the Invention

The present invention relates to a jack, and more particularly to a jack assembly for elevating vehicles having higher base.

2. Description of the Prior Art

Typical screw jacks comprise a limited elevation stroke such that the jacks may elevate vehicles having lower base only.

The present invention has arisen to mitigate and/or obviate the afore-described disadvantages of the conventional screw jacks.

SUMMARY OF THE INVENTION

The primary objective of the present invention is to provide a jack assembly which may be used for elevating vehicles having higher base.

In accordance with one aspect of the invention, there is provided a jack assembly comprising a jack assembly comprising a base, a first cylinder and a second cylinder disposed on the base and including a first piston rod and a second piston rod respectively, the first piston rod and the second piston rod each including an upper end, means for actuating the cylinders in order to move the piston rods, a slide slidably engaged on the first cylinder and secured to the upper end of said second piston rod so as to be moved upward by the second piston rod, a first pair of lever means having a lower portion pivotally coupled to the slide and having an upper portion, a second pair of lever means having a lower portion pivotally coupled to the upper portion of the first pair of lever means and having an upper portion, a support means, the upper portion of the second pair of lever means being pivotally coupled to the support means, and link means pivotally coupling the first pair of lever means to the upper end of the first piston rod so as to elevate the support when the first piston rod is moved upward relative to the first cylinder. The support is elevated when the slide is moved upward by the second cylinder, and the support is further elevated when the first cylinder is actuated.

The support includes an extension laterally extended therefrom for supporting vehicles. The base includes a side portion having wheel means secured thereto for moving the jack assembly. The actuating means includes an actuator disposed on the base, a handle for pumping the actuator, and a container for accommodating oil and for supplying oil to the actuator.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
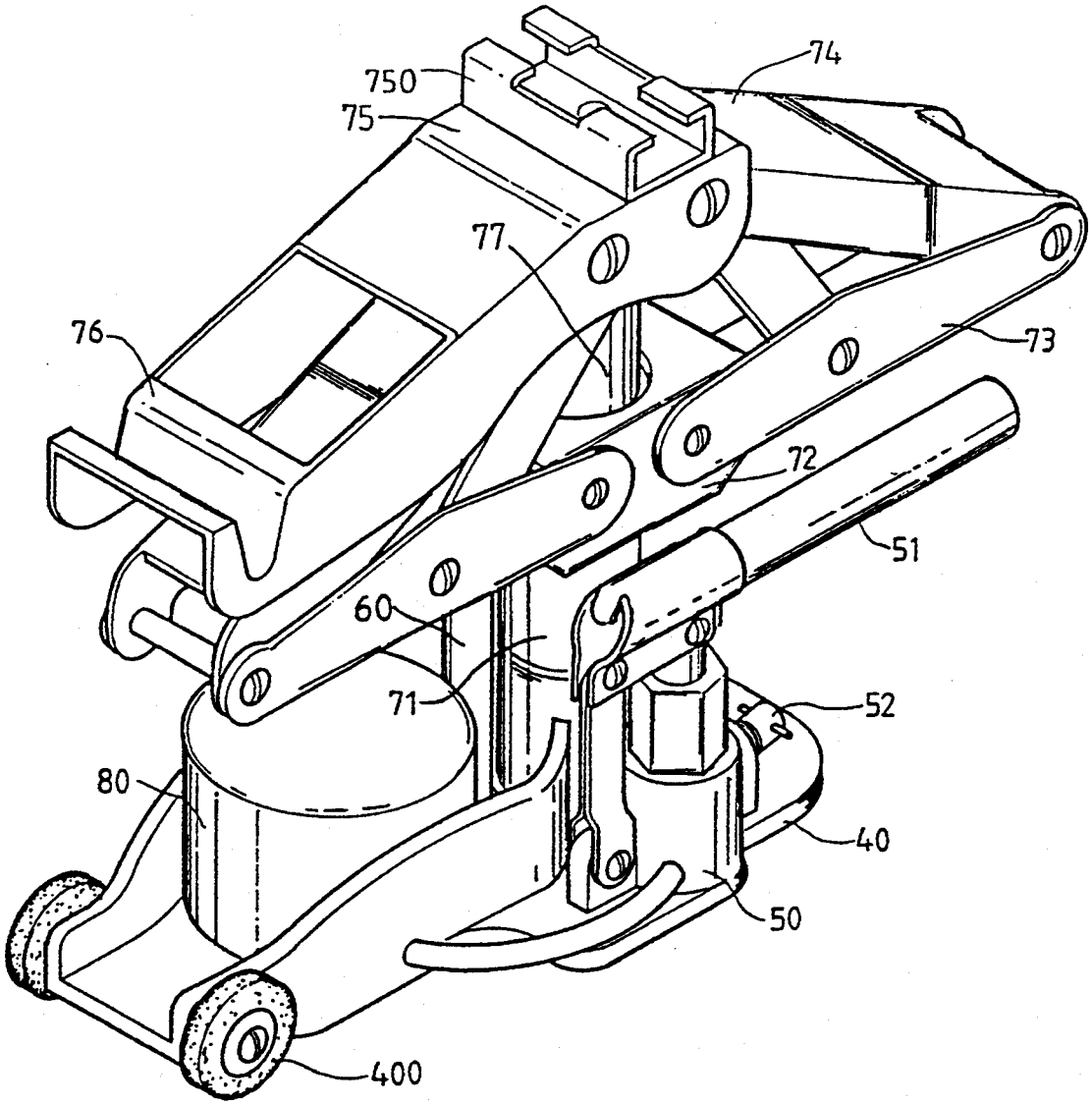
FIG. 1 is a perspective view of a jack assembly in accordance with the present invention.

Referring to the drawings, and initially to FIGS. 1 to 4, a jack assembly in accordance with the present invention comprises a base 40 including an actuator 50 disposed thereon and a container 80 for accommodating oil and for supplying oil into the actuator 50. The actuator 50 includes a release valve 52 disposed in the lower portion and a handle 51 disposed on the upper portion for actuating the actuator 50. Two wheels 400 are secured to one end portion of the base 40 for moving the jack assembly when the base 40 is disengaged from the ground.

Two cylinders 60, 71 are disposed on the base 40 and each includes a piston rod 61, 77 extendible upward therefrom. The cylinder 71 includes a stop 710 secured on top thereof, best shown in FIGS. 3 and 4. A slide 72 is slidably engaged on the cylinder 71 and secured to the top of the piston rod 61 such that the slide 72 may be moved upward by the piston rod 61. A pair of levers 73 have lower portions pivotally coupled to the slide 72. Another pair of levers 74 have lower portions pivotally coupled to the upper ends of the levers 73. The upper ends of the levers 74 are pivotally coupled to a support 75 which includes a bracket 750 secured thereon and which includes an extension 76 laterally extended therefrom for supporting the base portion of the vehicles. A beam 78 is fixed on top of the piston rod 77. A pair of links 79 are pivotally coupled between the beam 78 and the levers 73 such that the support 75 may be elevated upward when the beam 78 is moved upward by the piston rod 77.

Figure 2:
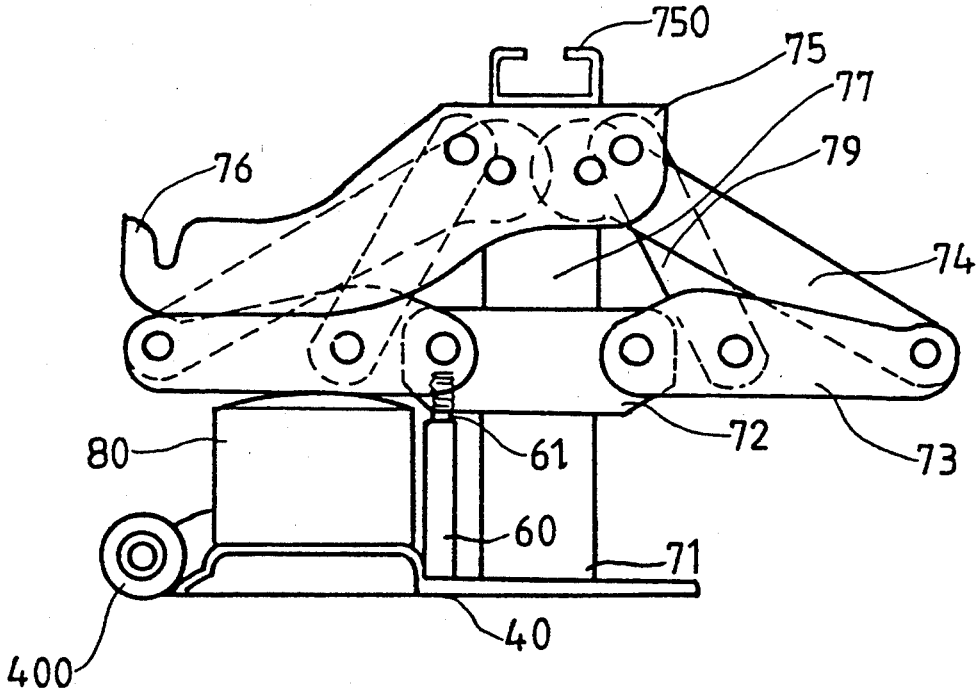
FIGS. 2, 3 and 4 are plane views illustrating the operation of the jack assembly.
Figure 3:
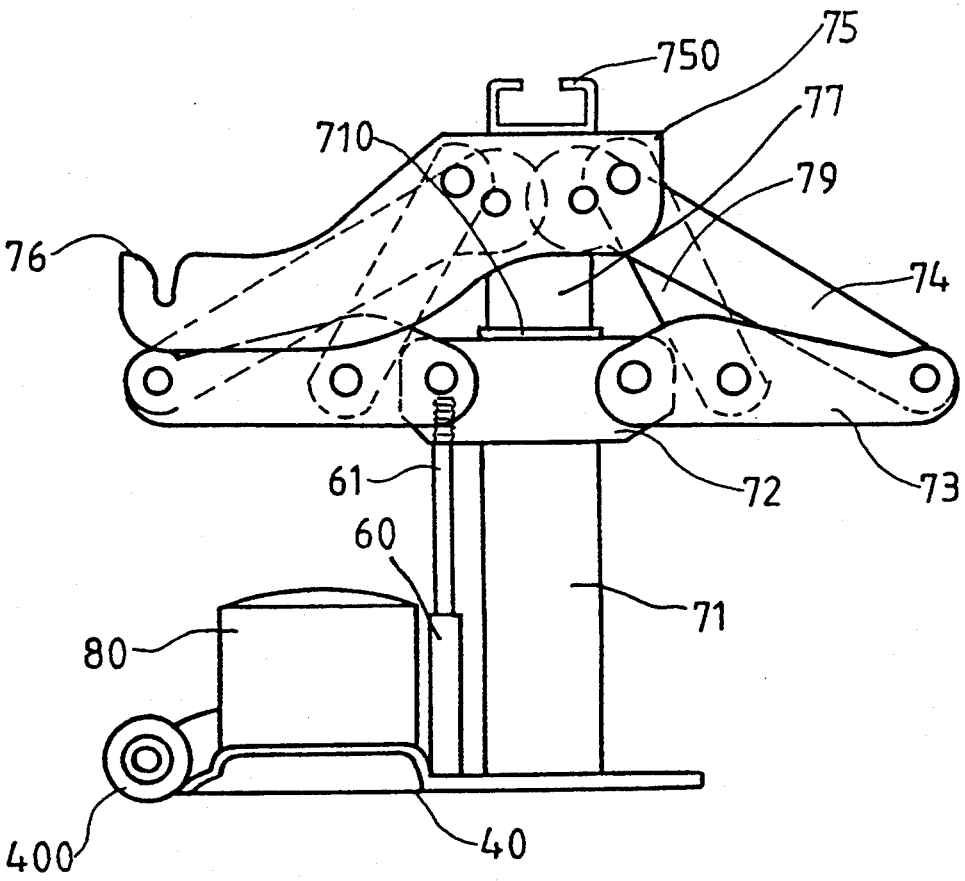
Figure 4:
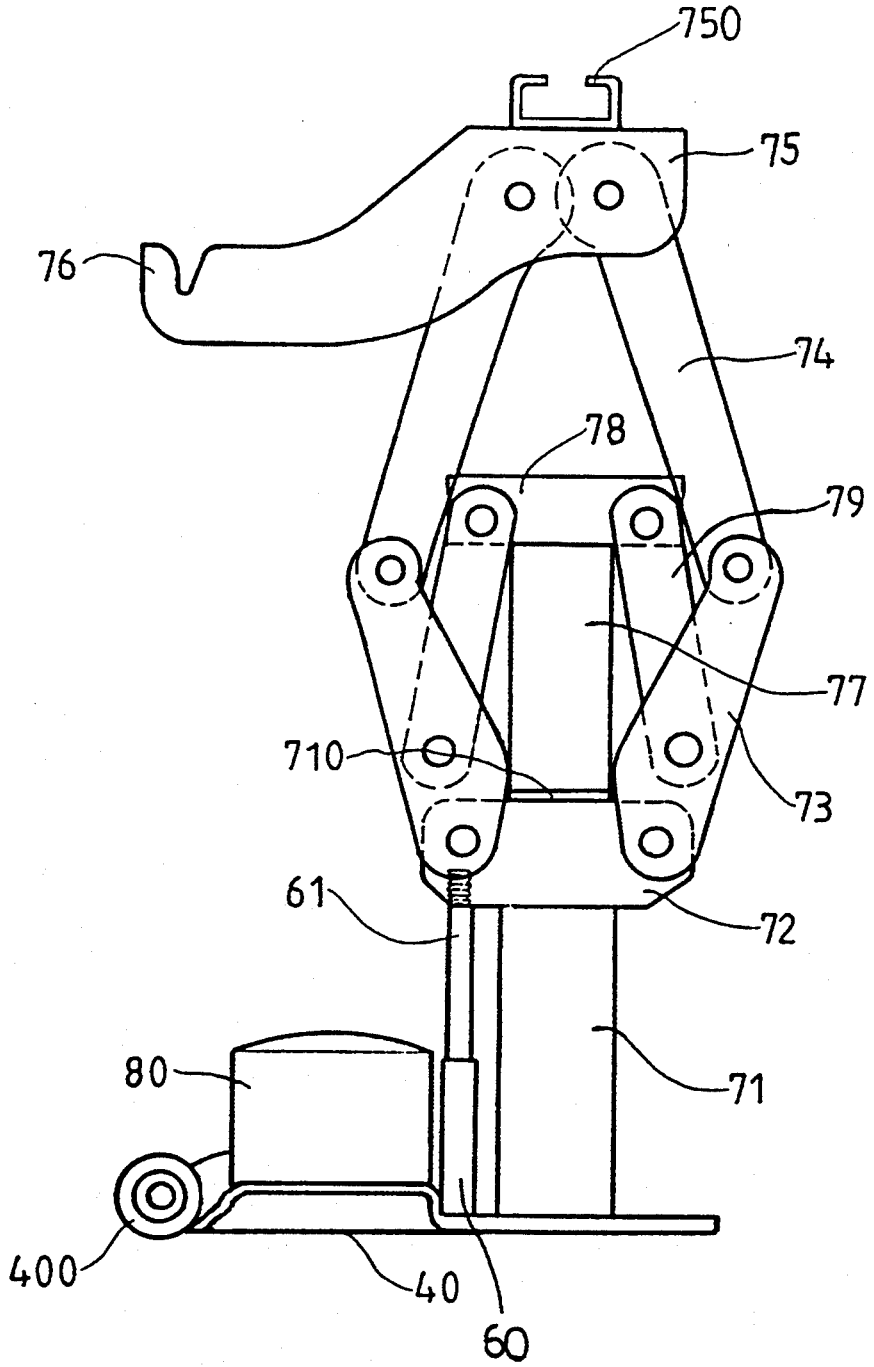
Figure 5:
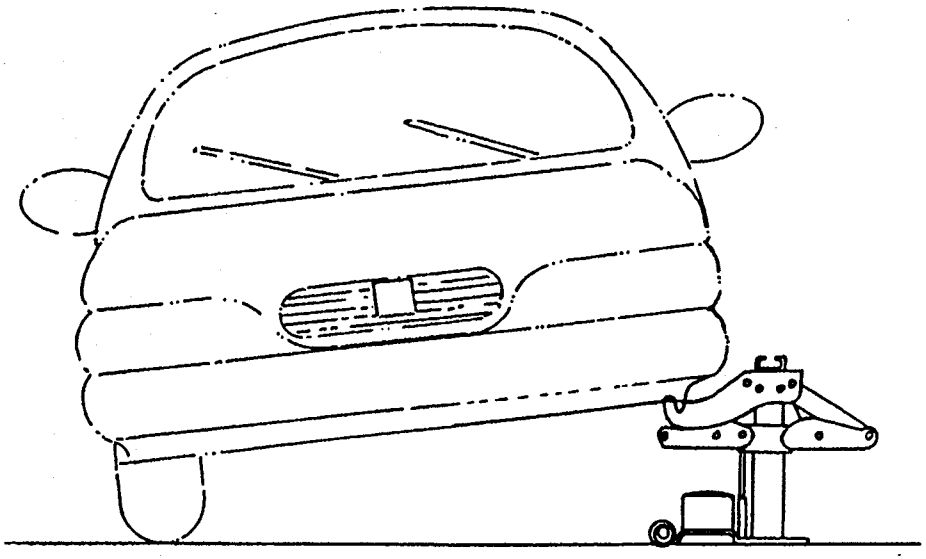
FIGS. 5 and 6 are plane views illustrating the application of the jack assembly.
Figure 6:
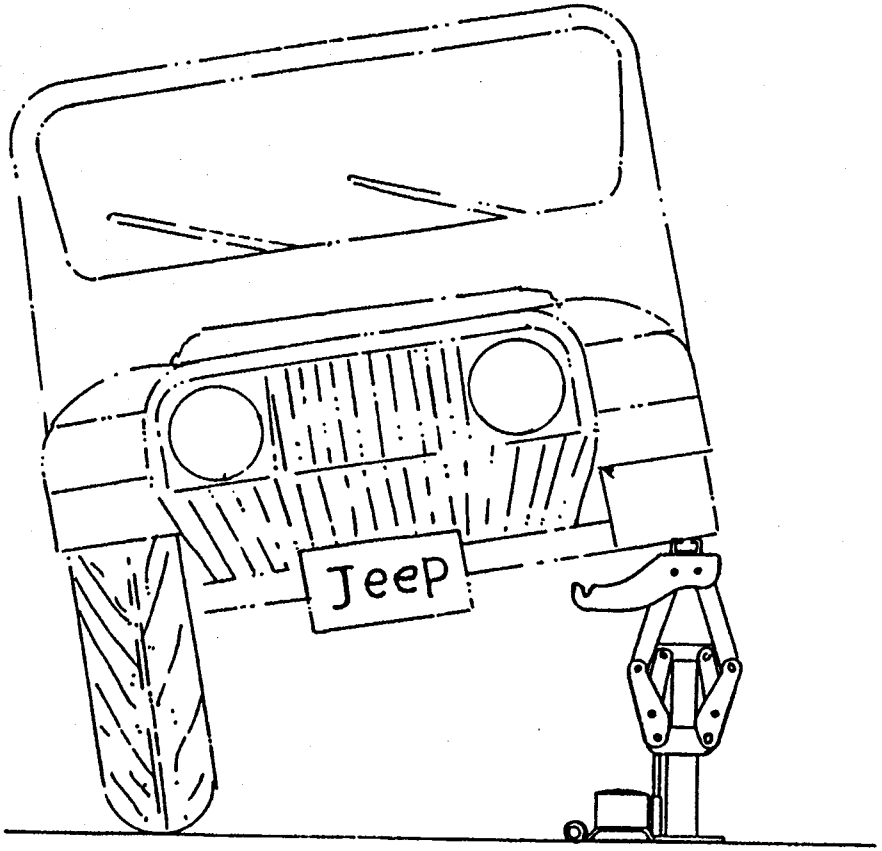

In operation, as shown in FIG. 2, when the piston rods 61, 77 are not extended outward of the cylinders 60, 71, both the slide 72 and the support 75 are located in the lower portion. As shown in FIGS. 3 and 5, when the actuator 59 is pumped with the handle 51, the piston rod 61 of the cylinder 60 is first moved upward in order to move the slide 72 upward until the slide 72 contacts the stop 710. At this moment, the jack assembly may be used for elevating vehicles having lower base. As shown in FIGS. 4 and 6, when the actuator 50 is further pumped with the handle 51, the piston rod 77 of the cylinder 71 is then moved upward in order to further move the support 75 upward. At this moment, the jack assembly may be used for elevating vehicles having higher base.

Accordingly, the jack assembly in accordance with the present invention can be used for elevating vehicles both having lower and higher base.

Although this invention bas been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A jack assembly comprising:

a base, a first cylinder and a second cylinder disposed on said base and including a first piston rod and a second piston rod respectively, said first piston rod and said second piston rod each including an upper end, means for actuating said cylinders in order to move said piston rods, a slide slidably engaged on said first cylinder and secured to said upper end of said second piston rod so as to be moved upward by said second piston rod, a first pair of lever means having a lower portion pivotally coupled to said slide and having an upper portion, a second pair of lever means having a lower portion pivotally coupled to said upper portion of said first pair of lever means and having an upper portion, a support means, said upper portion of said second pair of lever means being pivotally coupled to said support means, and link means pivotally coupling said first pair of lever means to said upper end of said first piston rod so as to elevate said support when said first piston rod is moved upward relative to said first cylinder, said support being elevated when said slide is moved upward by said second cylinder, and said support being further elevated when said first cylinder is actuated.

2. A jack assembly according to claim 1, wherein said support includes an extension laterally extended therefrom.

3. A jack assembly according to claim 1, wherein said base includes a side portion having wheel means secured thereto for moving said jack assembly.

4. A jack assembly according to claim 1, wherein said actuating means includes an actuator disposed on said base, a handle for pumping said actuator, and a container for accommodating oil and for supplying oil to said actuator.

* * * * *